US007094092B2

(12) United States Patent
Yang

(10) Patent No.: US 7,094,092 B2
(45) Date of Patent: Aug. 22, 2006

(54) LOW PROFILE CABLE CONNECTOR ASSEMBLY WITH GROUNDING SHIELD

(75) Inventor: Meng-Huan Yang, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/025,481

(22) Filed: Dec. 28, 2004

(65) Prior Publication Data

US 2005/0227531 A1 Oct. 13, 2005

(30) Foreign Application Priority Data

Apr. 9, 2004 (CN) ..... 2004 2 00262082

(51) Int. Cl.
*H01R 12/24* (2006.01)

(52) U.S. Cl. ..... 439/495; 439/607

(58) Field of Classification Search ..... 439/495–497, 439/108, 607, 610, 660
See application file for complete search history.

(56) References Cited

U.S. PATENT DOCUMENTS 4,381,129 A * 4/1983 Krenz ..... 439/497
4,602,830 A * 7/1986 Lockard ..... 439/108
4,640,562 A * 2/1987 Shoemaker ..... 439/77
5,385,478 A * 1/1995 Niekawa ..... 439/67
6,238,219 B1 5/2001 Wu
6,500,013 B1 12/2002 Wang

* cited by examiner

*Primary Examiner*—Khiem Nguyen
(74) *Attorney, Agent, or Firm*—Wei Te Chung

(57) ABSTRACT

A cable connector assembly (100) includes a first connector member (1) and a second connector member (2). The first connector member includes a first housing (13), a number of first contacts (14) received in the first housing and a first shell (11) enclosing the first housing. The first housing has a tongue plate (133). A grounding bar (12) attaches to the first housing and encloses the tongue plate. The second connector member includes a second housing (22), a number of second contacts (23) received in the second housing to electrically contacting with the first contacts and a second shell (21) enclosing the second housing. A room (24) is reserved between the second housing and the second shell adapted for receiving the tongue plate enclosed with the grounding bar of the first housing.

12 Claims, 6 Drawing Sheets

LOW PROFILE CABLE CONNECTOR ASSEMBLY WITH GROUNDING SHIELD

BACKGROUND OF THE INVENTION

1. Field of the Invention

The present invention relates to a cable connector assembly, and more particularly to a micro coaxial cable connector assembly having a relatively low profile and grounding shield.

2. Description of Prior Arts

A micro coaxial cable connector is widely used in high frequency communication connector field and is required to terminate a coaxial multiconductor cable. U.S. Pat. No. 6,500,013 discloses such a micro coaxial cable connector assembly. The micro coaxial cable connector assembly includes a connector main body and an insertion seat assembled therewith. The connector main body includes an insulative seat forming a hollow projecting section under bottom side thereof and defining multiple holes at top side thereof. A plurality of L-shaped terminals are received in the holes, with vertical sections of the terminals downwardly extending to the projecting section of the seat. An upper and lower covers mate with each other and surround the seat for grounding. The insertion seat includes a seat body retaining a plurality of L-shaped resilient terminals and a lateral cover attached to the seat body. Each resilient terminal includes raised section extending upwardly to electrically connect with the vertical section of corresponding terminal and outwardly extending and exposed out of the insertion seat to electrically connect to a printed circuit board on which the micro coaxial cable connector assembly is mounted.

Since used to transmit high-speed transmission, the micro coaxial cable connector assembly is required to attach the upper, lower and lateral covers thereon to prevent Electro Magnetic Interference (EMI) from outer environments. However, because of the exposed resilient terminals of the insertion seat, the micro coaxial cable connector assembly is susceptible to encounter EMI from external sources as well as from each other. Furthermore, since inherent amount of clearance that is designed between the connector main body and the insertion seat, there still remains room for decreasing in the height of such a micro coaxial cable connector assembly and simplicity in the structure thereof.

Therefore, it is necessary to develop an improved cable connector assembly to overcome the above shortcomings.

SUMMARY OF THE INVENTION

A first object of the present invention is to provide a cable connector which provides an improved grounding shield and mates with a header connector vertically mounted on a printed circuit board.

A second object of the present invention is to provide an improved cable connector assembly which has a minimized low profile configuration as well as maintaining a reliable grounding effectiveness.

To achieve the first object, a cable connector in accordance with the present invention comprises a dielectric housing, a plurality of conductive contacts and a metal shell enclosing the housing. The housing defines a plurality of passageways for receiving corresponding contacts therein. Each contact has a mating portion at a free end thereof for electrically connection with a complementary connector and a tail portion at an opposite end thereof for electrically connection with a mating cable set. Further, the housing has a tongue plate at a front side thereof. A grounding bar attaches to the first housing and encloses the tongue plate and electrically connects with the shell for cooperatively fulfilling Electro Magnetic Interference requirement and meeting strain relief requirement.

To achieve the second object, a cable connector assembly in accordance with the present invention includes a first connector member and a second connector member. The first connector member includes a first housing, a plurality of first contacts received in the first housing and a first shell enclosing the first housing. The first housing has a tongue plate at a front side thereof. A grounding bar attaches to the first housing and encloses the tongue plate and electrically connects with the first shell for cooperatively fulfilling Electro Magnetic Interference requirement and meeting strain relief requirement. The second connector member includes a second housing, a plurality of second contacts received in the second contacts to electrically contacting with the first housing and a second shell enclosing the second housing. A room is reserved between the second housing and the second shell in a front reign adapted for receiving the tongue plate with the grounding bar of the first housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Referring to FIGS. 1 to 4, a cable connector assembly 100 in accordance with the present invention comprises a first connector member 1 and a second connector member 2. In a preferred embodiment, the first connector member 1 is a micro coaxial cable connector and the second connector member 2 is a header connector.

Figure 5:
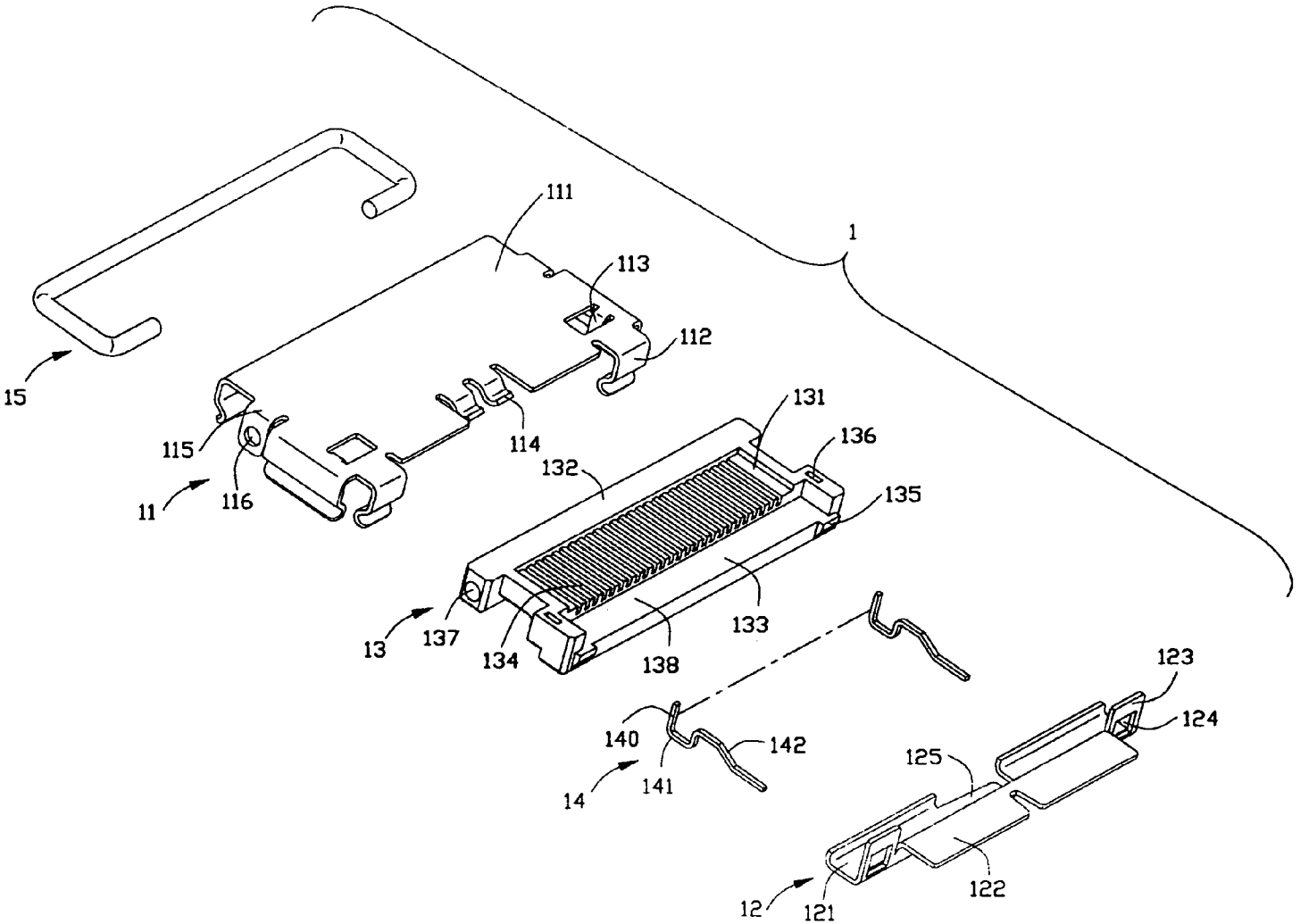
FIG. 5 is an exploded view of the first connector member shown in FIGS. 3 and 4.

Particularly referring to FIG. 5, the micro coaxial cable connector 1 comprises a first metal shell 11, a grounding bar 12, a first dielectric housing 13, a plurality of first conductive contacts 14 and a pulling wire 15.

The first housing 13 includes a rod 133, a main portion 131 extending forwardly from the rod 132, and a tongue plate 133 extending forwardly from a front lower portion of the main portion 131. A plurality of grooves 134 longitudinally extend through the middle reign of the main portion 131 and the rod 132 along a front-to-rear direction. A pair of recesses 136 are defined at opposite side edges of the main portion 131. A pair of protrusions 135 respectively forwardly protrude from front side ends of the tongue plate 133. A pair of mounting holes 137 are defined in opposite lateral ends of the rod 132. Further, the first housing 13 has a receiving space 138 opening forwardly for receiving a mating cable set (not shown).

The first contacts 14 are arranged in a row corresponding the grooves 134 of the first housing 13. Each first contact 14 includes a horizontally retention portion 141, a mating portion 140 bending and extending upwardly from a rear end of the retention portion 141, and a step-shaped tail portion 142 forwardly extending from a front end of the retention portion 141 for electrically connection with signal ends of the mating cable set.

The first shell 11 includes a plate portion 111 with plural pairs of bent grounding fingers 112. A pair of claws 113 are bent downwardly at opposite lateral edges of the plate portion 111. A pair of spring fingers 114 bents forwardly from a front middle edge of the plate portion 111 for resiliently pressing the mating cable set and connection with grounding means of the mating cable set. And a pair of tabs 115 extends vertically from rear side edges of the plate portion 111, wherein each tab 115 defines a round hole 116 corresponding to the mounting hole 137 of the first housing 13.

The grounding bar 12 has an elongate U-shaped strip 121, an extension slat 122 forwardly extending from front middle edge of the strip 121 generally protecting mating cable set from stresses, and a pair of upright plate 123 extending upwardly from front side edges of the strip 121. Each upright plate 123 defines a bore 124 for receiving a corresponding protrusion 135 therein. Further, the strip 121 defines a cutout (not labeled), a resilient finger 125 bending downwardly at a specific angle from an edge of the cutout for soldering to a printed circuit board (not shown) on which the cable connector assembly 100 is mounted.

Figure 6:
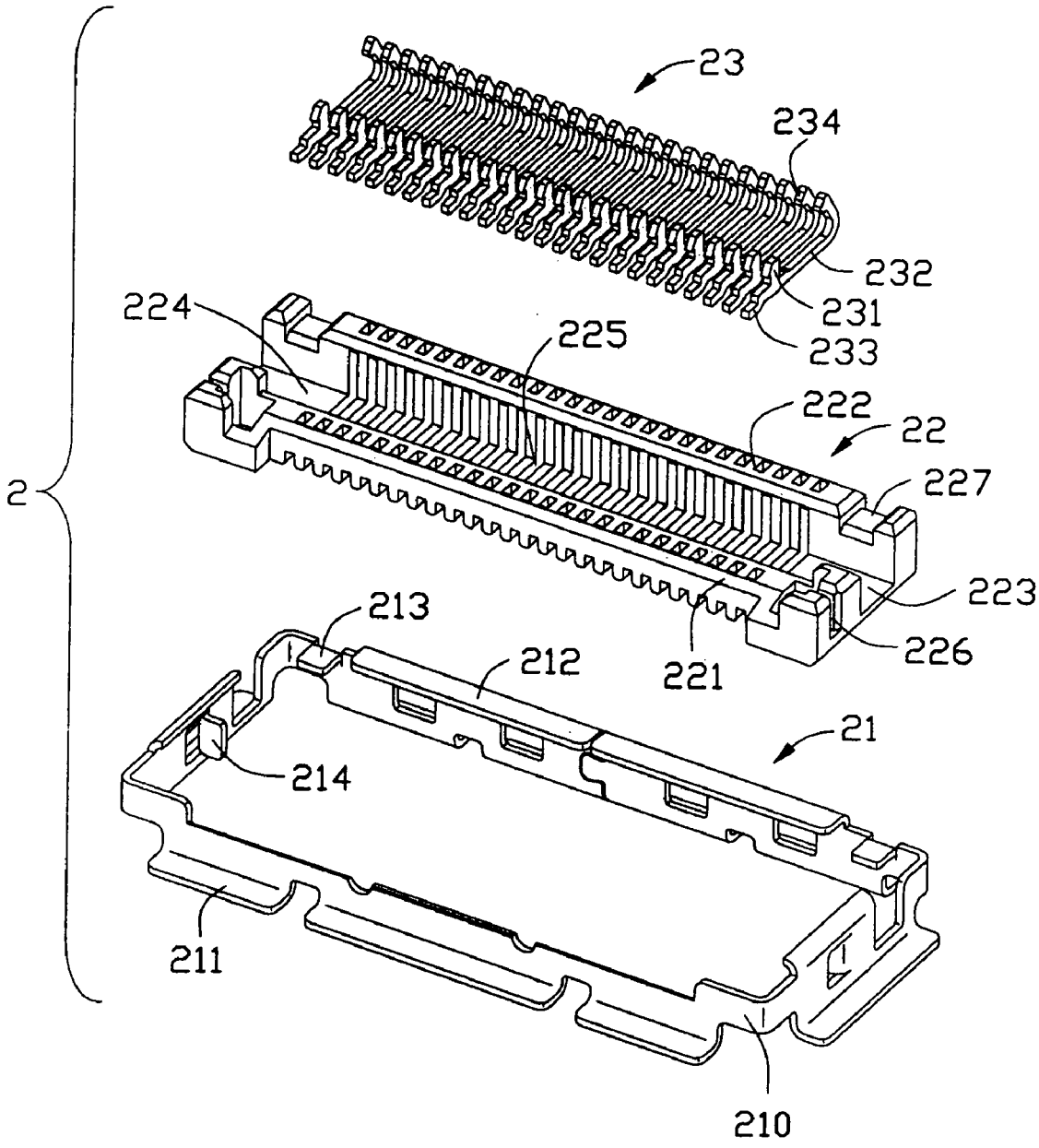
FIG. 6 is an exploded view of the second connector member shown in FIGS. 3 and 4.

Now turning to FIG. 6, the header connector 2 includes a second shell 21, a second dielectric housing 22 and a plurality of second conductive contacts 23.

The second housing 22 is of a substantially elongated U-shaped configuration defined by a front wall 221, a rear wall 222 and a joint wall 223 joining therebetween. An opening 224 is defined between the front wall 221, the rear wall 222 and the connection portion 223 for receiving the rod 132 of the micro coaxial cable connector 1 therein. A plurality of passageways 225 longitudinally extend through the opposite front and rear walls 221, 222 and the connection portion 223, each in communication with the opening 224. A pair of notches 226 and a pair of depressions 227 are respectively defined at opposite outmost portion of the front wall 221 and the rear wall 222, wherein the plurality of passageways 225 are distributed therebetween.

The second contact 23 are received in the passageways 225 of the second housing 22. Each second contact 23 includes a vertically arrow headed fixing portion 231, a horizontally joint portion 232 extending rearwardly from a lower portion of a rear side of the fixing portion 231, a hook-shaped contacting portion 234 bending upwardly and inwardly at a specific angle from distal end of the joint portion 232, and a step-shaped connection portion extending forwardly from a lower portion of a front side of the fixing portion 231 for connection with the PCB.

The second shell 21 is stamped to be of a single metal plate, with a close frame 210 and a plurality of bent grounding ends 211. A pair of flanges 212 are formed at a top middle reign of the frame 210 and bend forwardly in a juxtaposed manner for covering top face of the rear wall 222 of the second housing 22. A pair of paws 213 are formed at top side edges of the frame 210 and bend forwardly and are slightly lower than the flanges 212 for entering into corresponding depressions 226 of the second housing 22. A pair of barbs 214 inwardly extend on opposite lateral sides of the frame 210 for biting into the notches 227 of the second housing 22.

Now returning to FIG. 5, in assembly, the first contacts 14 are over-molded with the first housing 13. The retention portions 141 are integrally received in the rod 132. The mating portions 140 and the tail portions 143 are respectively received in the grooves 134 defined in the rod 132 and the main portion 131. Then the grounding bar 12 is assembled to the first housing 13 in a front-to-rear direction. The protrusions 135 formed on the tongue plate 133 of the first housing 13 respectively bite into corresponding bores 124 of the grounding bar 12. The strip 121 covers the lower face of the tongue plate 133 and the extension slat 122 disposes flush with upper face of the tongue plate 133. In assembly of the first shell 11 with the first housing 13, the claws 113 the first shell 11 downwardly protrude into the recesses 136 defined in the opposite lateral sides of the main portion 131 of the first housing 13. The grounding fingers 112 of the first shell 11 abut against lower faces of the protrusions 135 and the lateral side ends of the main portion 131. The tabs 115 of the first shell 11 covers the lateral ends of the rod 132, with the mounting holes 116 aiming at the round holes 137. Lastly, the pulling wire 15 is assembled to the first housing 13 with corresponding portions respectively inserted through the round holes 137 and received in the mounting holes 116.

Now returning to FIG. 6, the second contacts 23 are inserted into the second housing 22 in a bottom-to-up direction. The contacting portions 234 expose within the opening 224 defined by the front wall 221, the rear wall 222 and the joint wall 223. The fixing portions 231 and the joint portions 232 protrude through the passageways 225 defined in the rear wall 222 and respectively received in the passageways 225 defined in the front wall 221 and the joint wall 223. The connection portions 223 forwardly project beyond of the passageways 225 for electrical connection with the PCB. Then the second shell 21 is assembled to the second housing 13. The flanges 212 formed at a top middle reign of the second shell 21 cover the top face of the rear wall 222 of the second housing 22. The paws 213 formed at top side edges of the second shell 21 enter into corresponding depressions 226 of the second housing 22. And the barbs inwardly extend on opposite lateral sides of the second shell 21 bite into the notches 227 of the second housing 22. It is also noted that a cavity 24 is reserved between the second housing 22 and the second shell 21 in a front reign of the assembled header connector 2.

Figure 1:
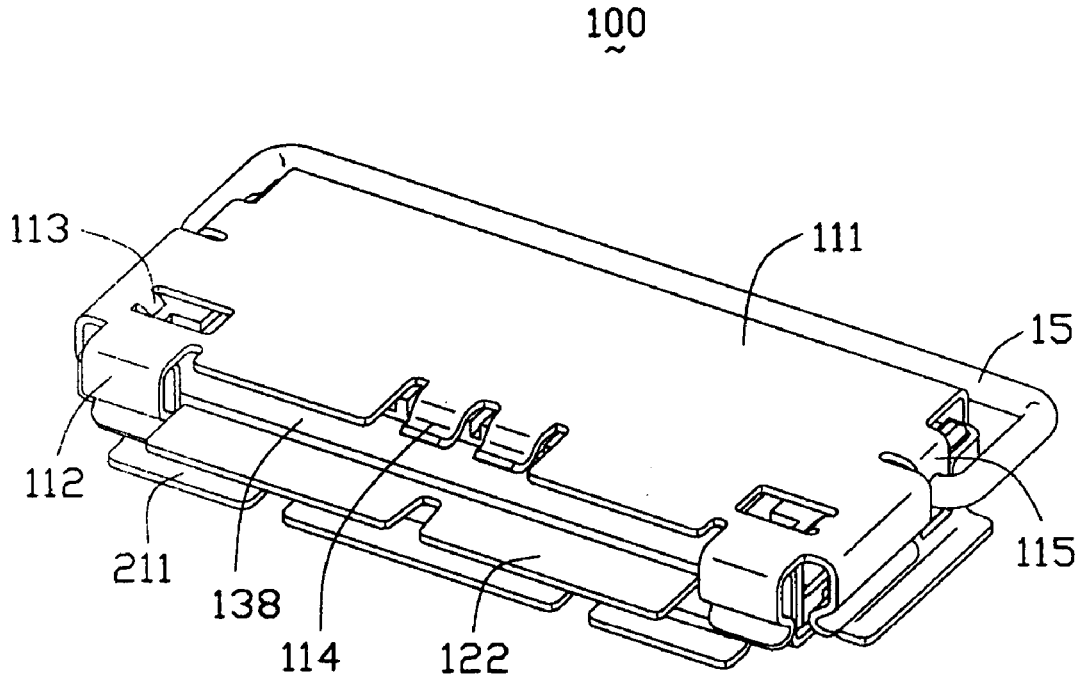
FIG. 1 is a perspective view of a cable connector assembly in accordance with the present invention, wherein the cable connector assembly comprises a first and a second connector member.
Figure 2:
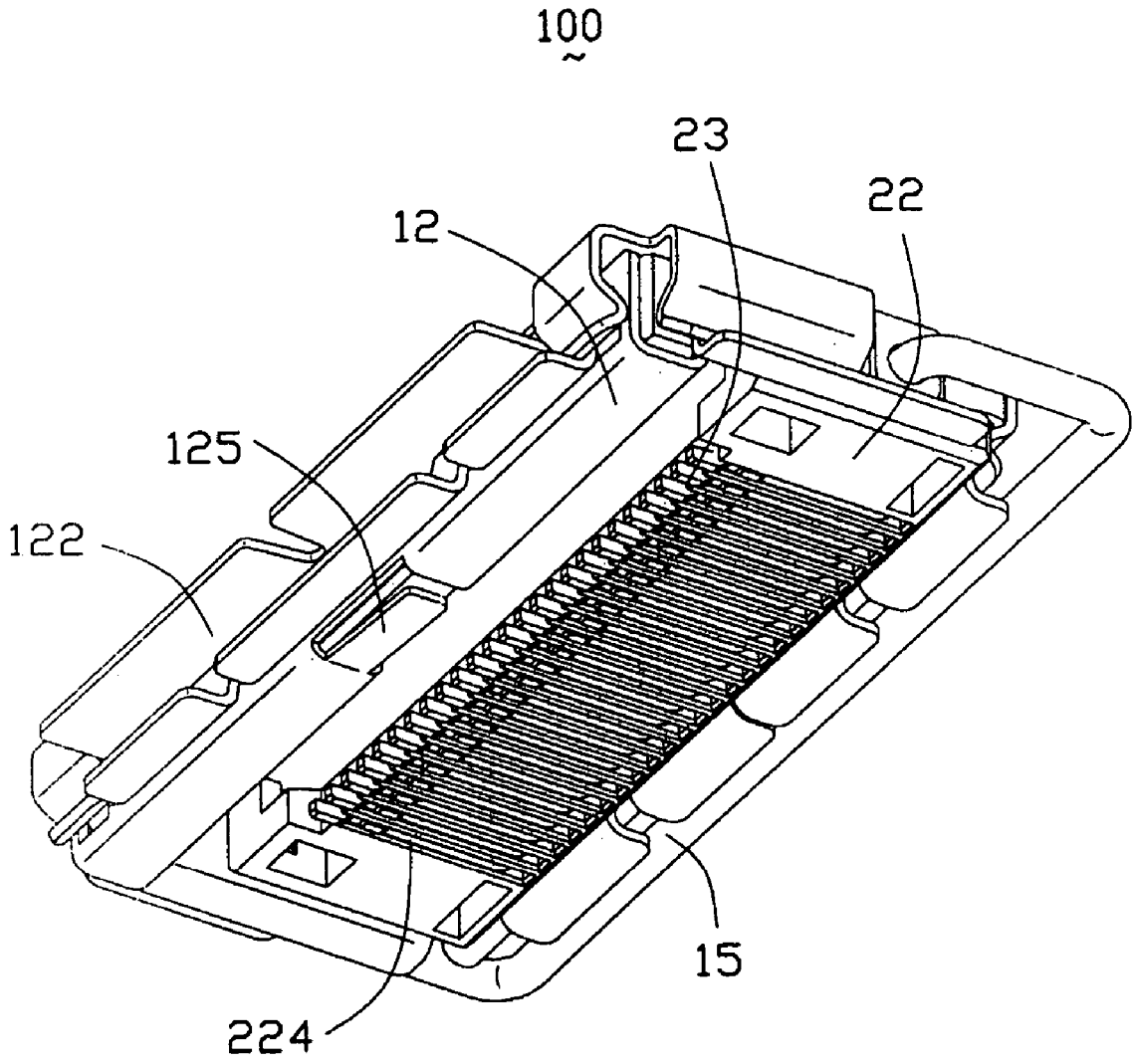
FIG. 2 is a view similar to FIG. 1, but taken from a different aspect.
Figure 3:
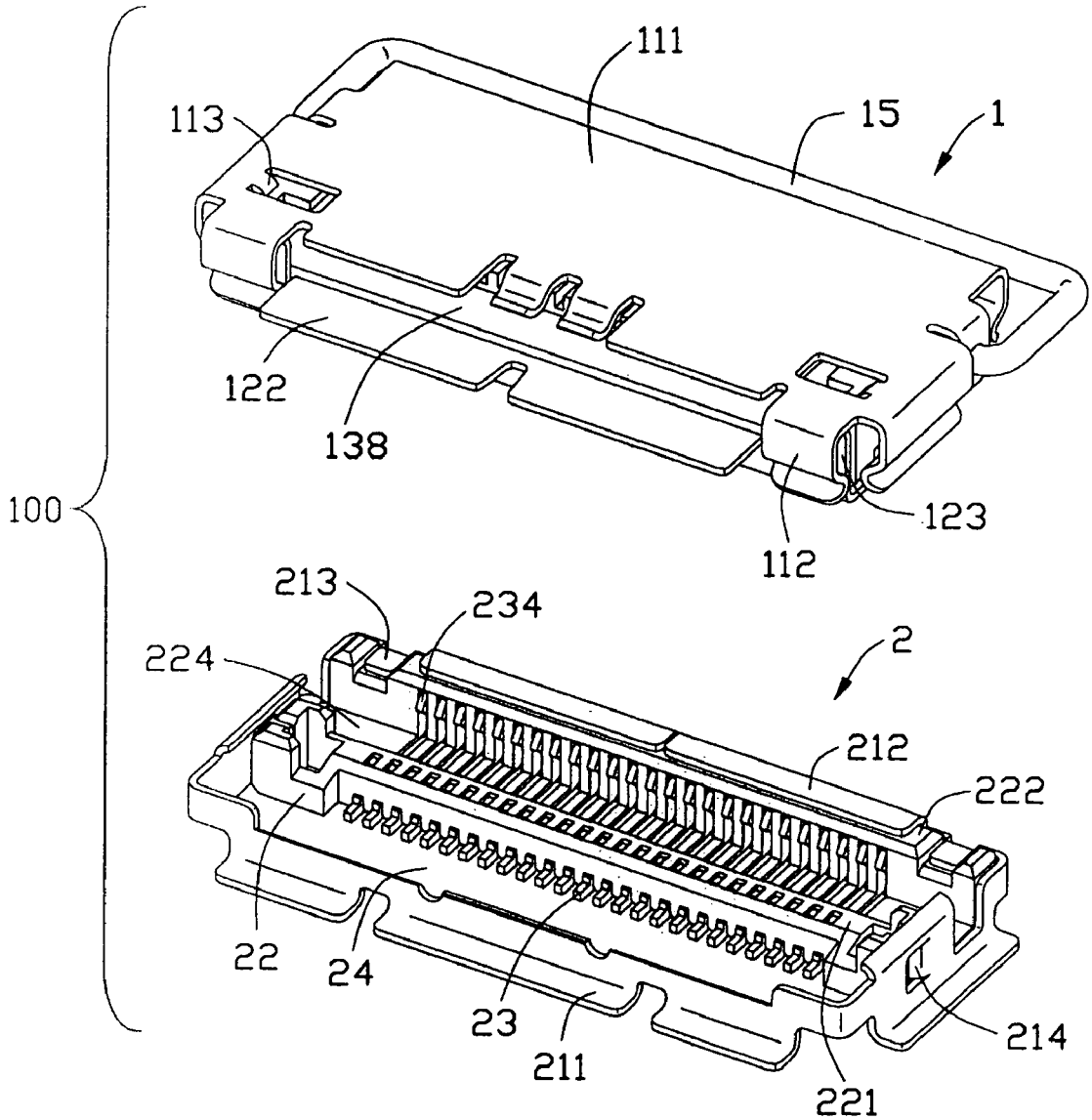
FIG. 3 is an exploded, perspective view of the cable connector assembly of FIG. 1.
Figure 4:
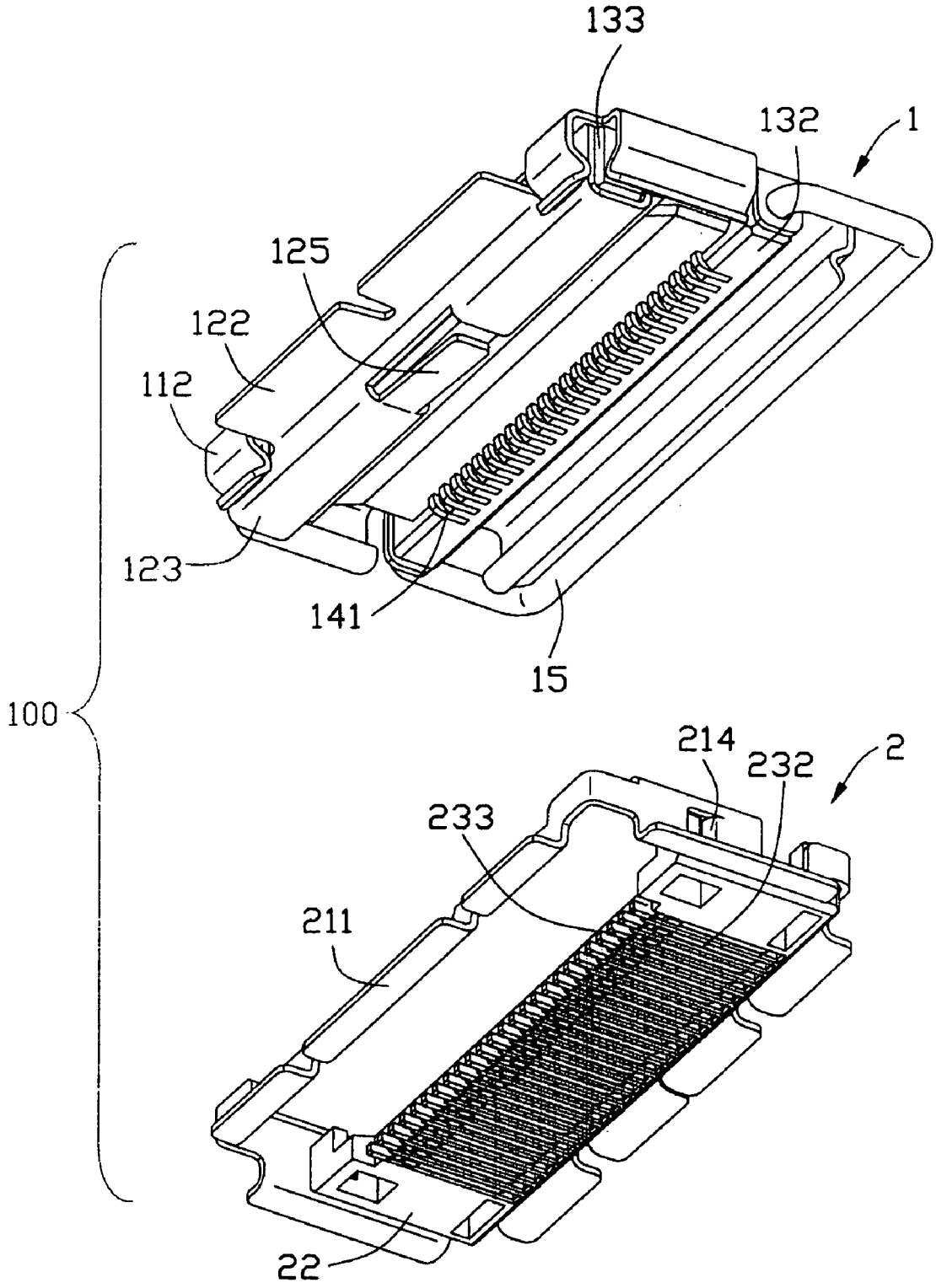
FIG. 4 is a view similar to FIG. 3, but taken from a different aspect.

Referring to FIGS. 3 and 4, the micro coaxial cable connector 1 is assembled to the header connector 2 in an up-to-bottom direction. The rod 132 is disposed within the opening 224, therefore, an electrical engagement between the mating portions 140 of the first contacts 14 and the contacting portions 234 of the second contacts 23 is established. Meanwhile, the tongue plate 133 surrounded with the grounding bar 12 is fitly disposed within the cavity 24. The grounding fingers 112 of the first shell 11 electrically engage with the frame 210 of the second shell 21. As a result, a grounding path is built from the grounding means of the mating cable set, through the grounding bar 12, the first and second shell 11 and 21 contacting with each other, to the PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for mounting in a printed circuit board, comprising:

a first connector member adapted for electrical connection with a mating cable set, comprising:

a first dielectric housing having a tongue plate at front side;

a plurality of first contacts received in the first housing, each first contact including a mating portion at a free end and a tail portion at an opposite end adapted for electrically contacting with the mating cable set;

a first shell enclosing the housing; and a grounding bar attached to the first housing and enclosing the tongue plate adapted for cooperatively fulfilling Electro Magnetic Interference requirement;

a second connector member adapted for electrically connection with the first connector, comprising:

a second dielectric housing;

a plurality of second contacts received in the second housing, each second contact having a contacting portion at a free end adapted for electrically contacting with a mating portion of a corresponding first contact of the first housing;

a second shell enclosing the second housing, a room reserved between the second housing and the second shell adapted for receiving the tongue plate with the grounding bar, thereby establishing a grounding path from the mating cable set to the printed circuit board.

2. The cable connector assembly as described in claim 1, wherein the grounding bar has a strip covering lower face of the tongue plate and a resilient finger downwardly bending at a special angle from the strip to solder to the PCB.

3. The cable connector assembly as described in claim 1, wherein the grounding bar further has an extending slat extending forwardly from the strip.

4. The cable connector assembly as described in claim 1, wherein the first housing has a rod and a main portion extending forwardly from the rod, the tongue plate extending forwardly from the main portion and the rod and the main portion defining a plurality of grooves for receiving the first contacts.

5. The cable connector assembly as described in claim 1, wherein the second housing defines an upwardly exposed opening for receiving the rod of the first housing, whereby the mating portions of the first contacts electrically contact with the contacting portions of the second contacts.

6. The cable connector assembly as described in claim 1, wherein the second shell has a close frame and a plurality of grounding ends extending from the frame for soldering to the printed circuit board.

7. The cable connector assembly as described in claim 6, wherein the first shell has a plurality of grounding fingers downwardly extending for electrically engaging with the close frame of the second shell.

8. The cable connector assembly as described in claim 1, wherein the first shell has a plate portion, a plurality of spring fingers extending forwardly from the plate portion for resiliently pressing the mating cable set and connection with the grounding means of the mating cable set.

9. The cable connector assembly as described in claim 1, wherein the cable connector assembly further comprises a pulling wire assembled to the first connector member.

10. An electrical connector assembly comprising:

a first connector including:

a first insulative housing including a downwardly extending tongue plate;

a plurality of first contacts disposes in the first housing;

a first metallic shell enclosing the first housing, said metallic shell vertically cooperating with the tongue plate to define an opening for receiving an electronic part having means mechanically and electrically connecting the first contacts;

a second connector coupled to the first connector including:

a second insulative housing mated with the first housing;

a plurality of second contacts disposed in the second housing and mated with the corresponding first contacts, respectively;

a second metallic shell enclosing said second housing and horizontally cooperating with said second housing to define aside a space receiving the downwardly extending tongue plate and corresponding portions of the first metallic shell therein.

11. The assembly as claimed in claim 10, wherein the first shell includes means cooperating with the downwardly extending tongue plate to sandwich the second shell therebetween.

12. The assembly as claimed in claim 11, further including a ground bar enclosing said tongue plate, and thus said ground bar cooperates with the first shell to sandwich the second shell therebetween.

* * * * *